US005247946A

United States Patent [19]

Holder

[11] Patent Number: 5,247,946

[45] Date of Patent: Sep. 28, 1993

[54] EAR PIECE

[76] Inventor: Jack M. Holder, 5990 Bird Rd., Miami, Fla. 33155

[21] Appl. No.: 886,364

[22] Filed: May 21, 1992

[51] Int. Cl.[5] ..... A61H 39/04

[52] U.S. Cl. ..... 128/864; 128/907

[58] Field of Search ..... 128/907, 846, 853, 864, 128/865, 866, 867, 868, 24 R, 24.1, 67

[56] References Cited

U.S. PATENT DOCUMENTS

| | | | |
|---|---|---|---|
| D. 273,706 | 5/1984 | McCall | 128/907 X |
| 4,267,838 | 5/1981 | McCall | 128/907 X |
| 4,450,846 | 5/1984 | McCall | 128/907 X |
| 4,966,164 | 10/1990 | Colsen et al. | 128/907 X |

FOREIGN PATENT DOCUMENTS

| | | | |
|---|---|---|---|
| 2216800 | 10/1989 | United Kingdom | 128/907 |

*Primary Examiner*—Robert A. Hafer
*Assistant Examiner*—Sam Rimell
*Attorney, Agent, or Firm*—Malloy & Malloy

[57] ABSTRACT

An improved ear piece to be inserted and dwell on the human outer ear wherein the ear piece has an upper portion overlaying the triangular fossa, a lower portion overlaying the inferior and superior concha and concha ridge areas, and a grooved bridge portion interconnecting the upper and lower portions to receive and embrace the inferior crus; the lower portion includes a terminal end with a through hole sized and configured to allow sound to enter into the ear canal and the upper portion has a nose portion sized and ccnfigured to nest in the internal helix above the inferior crus of a human ear covering the triangular fossa, wherein the ear piece may be of rigid plastic or of rubbery material and may contain a pattern in relief on the surface which confronts the surface of the ear cavity in a pre-selected pattern to correspond to certain ear acupuncture points, and may contain a pattern of magnets on the surface which confronts the surface in the ear cavity in a pre-selected pattern to correspond to certain acupuncture points.

10 Claims, 1 Drawing Sheet

EAR PIECE

FIELD OF THE INVENTION

This invention relates to an improved ear piece which is designed, sized, and configured to dwell in a outer human ear and which for auriculotherapy purposes, may include an inside surface to confront the ear surface which has a pattern in relief or a pattern of magnets which, in use, stimulates selected acupuncture points on the anatomical areas of the ear surface. The invention is also of an ear piece which dwells in a human ear and includes a configuration designed to retain the ear piece in the ear for extended periods of time. Magnets, as described more fully herein, may be located on the surface of the ear piece for the same purpose as described above.

BACKGROUND OF THE INVENTION

On various anatomical areas of the human ear, there have been identified various points, known as acupuncture points, which are stimulated in auriculotherapy. In treatment procedures, these points are stimulated by inserting an ear piece into the human outer ear, which ear piece has a surface which confronts certain selected acupuncture points of selected anatomical areas. The ear piece has raised portions or bumps on the ear piece surface confronting the ear at locations corresponding to selected acupuncture points or magnets placed at certain locations to correspond to selected acupuncture ear points.

Ordinarily, treatment is conducted with respect to the anatomical areas below the inferior crus, namely, the superior and inferior concha areas as well as the concha ridge. Such treatment has not been applied in the upper zone of the ear, known as the triangular fossa, although it is known that there are points in that area which are also acupuncture points.

One of the problems of conventional ear pieces is that users often experience trouble because the ear pieces are not maintained securely within the ear structure. An object of this invention is to provide an ear piece designed and configured to dwell in the human ear and to be retained therein by a companionate co-action of the configuration of an ear piece with the human ear structure.

The ear piece, accordingly, includes a) a first portion which overlays the triangular fossa area, b) a second portion that overlays the inferior and superior concha areas, and c) a third portion that embraces the inferior crus. The first portion extends into the internal helix beneath the helix root. The second portion has a groove sized to overlay and embrace the inferior crus. The third portion extends into the ear canal. These three portions, in combination with the ear structure, co-act and serve as a holding means for the ear piece when in use.

In the past, a pattern in relief of bumps on the surface of the ear piece had been provided to selectively confront selected acupuncture points on the surfaces of an ear. It has been known to provide an ear piece which has a surface which has bumps in a pattern which overlays the superior and inferior concha and the concha ridge. It is intended that the pattern corresponds to selected acupuncture points. These ear pieces have been of rigid plastic material. In use, some patients have found this type of ear piece to be painful in use over a period of time. Hence, such device have not been used effectively by certain patients. This invention has as one of its objects the provision of an ear piece of rubbery material so as to be comfortable and susceptible to long term and effective use and which is sized and configured as set forth above to be retained by co-action with the ear structure. Another object is an ear piece configured as described above and generally herein which is of rigid material with a pre-selected pattern of bumps to confront the ear surface. The bumps may be embossed portions of the rigid material or a pre-selected pattern of magnet surfaces which protrude from the surface of the ear piece, like crowns, and confront selected acupuncture points.

In the past, the pattern in relief of bumps, which corresponds to the acupuncture points, have been raised portions. This invention also contemplates a plurality of debossed recesses defining a pattern which corresponds to selected acupuncture points within an ear, and in each of which recesses there is a small, preferably cylindrical magnet. This has been found to be effective in auriculotherapy. In a preferred embodiment, the outside surface of the magnet or crowns extends slightly above the surface of the ear piece which in addition to magnetic action also provides bumps to engage the ear surface at the selected points.

SUMMARY OF THE INVENTION

Generally, this invention is of an ear piece which is generally S-shaped with: a) a lower generally C-shaped portion sized and configured to dwell in the ear with a surface confronting the superior and inferior concha which has a terminal portion to be received slightly in the ear canal, b) an upper generally C-shaped portion sized and configured to dwell in the ear with a surface confronting the triangular fossa, and c) a holder portion connecting the upper and lower portions. The holder portion bridges and receives the inferior crus. The grooved holder portion and upper portion defines a nose portion which extends beneath the helix root. In use, this ear piece is held in the ear by reason of this configuration and its companionate co-action with the ear structure.

The ear piece may be of rubbery material rather than a hard rigid plastic material, so as not to be painful when worn over an extended period of time. For auriculotherapy, the ear piece may include integral raised portions in a pattern corresponding to the acupuncture points within a human ear. Alternatively, a selected pattern of recesses may be provided in the surface of the ear piece which confronts the ear. In each of the recesses, there is secured a small magnet preferably sized and configured to extend slightly out of the inside surface of the ear piece to confront and stimulate acupuncture points within the ear.

BRIEF DESCRIPTION OF THE DRAWINGS

In accordance with the summary of the invention and the objects, the invention will now be described on reference to the accompanying drawings in which.

DESCRIPTION OF THE PREFERRED EMBODIMENT

Prior to referring to the actual ear piece, it will be helpful to consider the structure and to identify anatomical areas in reference to a surface view of a right ear. The right and left ears are mirror images of one another and, hence, will not be separately referred to in order to shorten this specification. Similarly, the left and right ear piece embodiments of the inventions are mirror images of one another and will not separately described to avoid unnecessary duplication.

Figure 1:
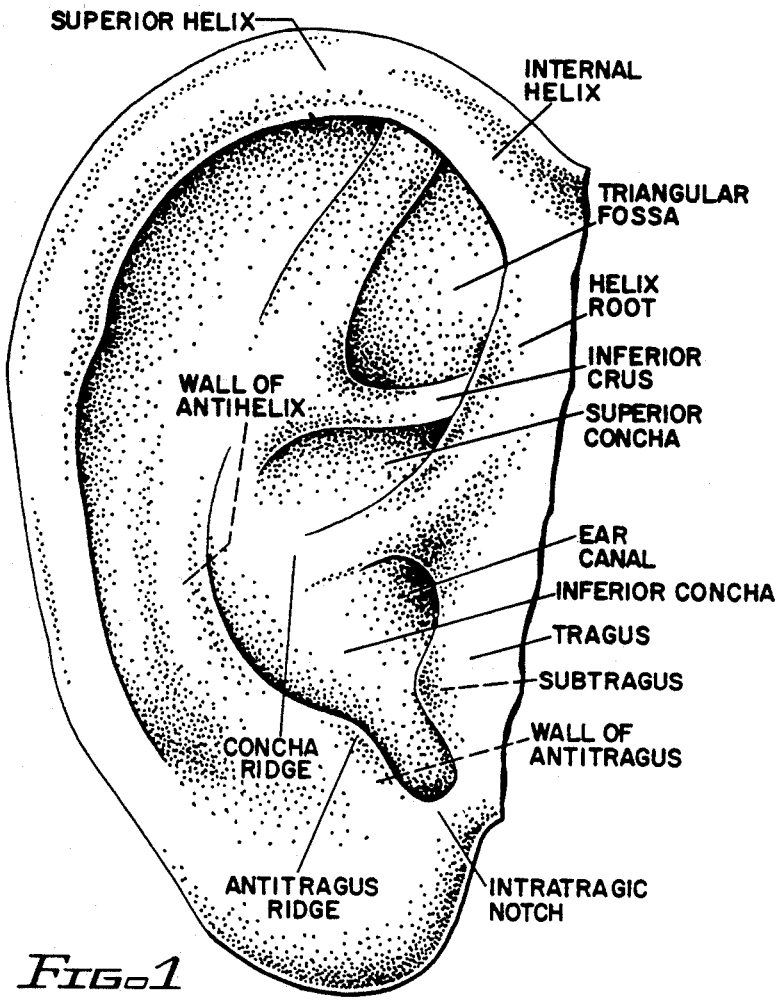
FIG. 1 is a drawing of anatomical areas comprising the surface view of the right ear of a human.
Figure 2A:
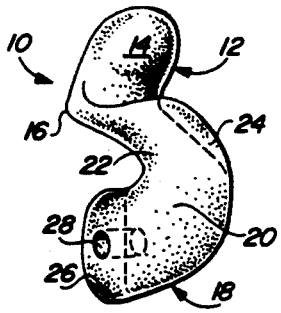
FIG. 2A is an elevation view of an ear piece in accordance with this invention.
Figure 2B:
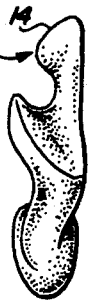
FIG. 2B is a right side elevation view of the ear piece shown in FIG. 2A.
Figure 2C:
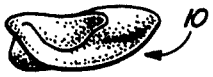
FIG. 2C is a top plan view of the ear piece shown in FIG. 2A.
Figure 2D:
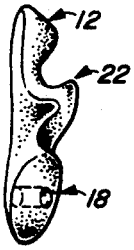
FIG. 2D is a left side view of the ear piece shown in FIG. 2A.
Figure 3A:
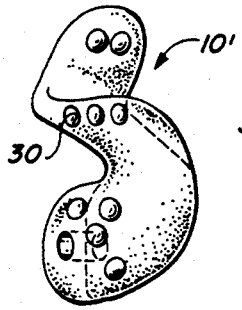
FIGS. 3A, 3B, 3C, and 3D are views corresponding to FIGS. 2A, 2B, 2C, and 2D and differing therefrom in that a pattern in relief is provided on the surface which confronts the ear which are in the form of bumps.
Figure 3B:
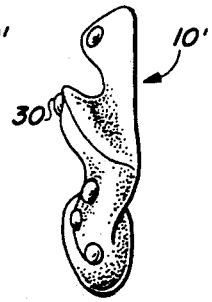
Figure 3C:
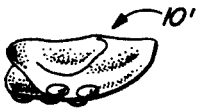
Figure 3D:
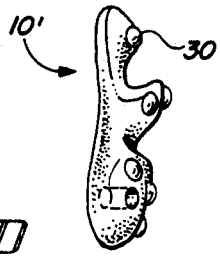

As shown in FIG. 1, which is of the anatomical areas of a surface view of the right ear, the ear generally is arranged about the mouth of an ear canal in the inferior concha surface beneath the tragus of the ear. The surface of the inferior concha merges and blends with the surface of the superior concha at the concha ridge, which continues upwardly and outwardly to form the helix root and superior helix of the ear structure. It is seen that the internal helix extends beneath the helix root providing a cavity which is utilized to form a holding means portion of the ear piece structure now to be described.

Generally, the ear piece 10, shown in FIGS. 2A–2D, is composed of several integral portions. There is an upper portion 12 which has a surface 14 which, in use, overlays and confronts the triangular fossa adjacent the inferior crus and it has a nose portion 16 which in use, extends beneath the helix root and into the cavity within the helix root known as the internal helix. The ear piece also has a lower portion 18 which overlays the superior and inferior concha and the concha ridge, there being a grooved portion 20 between the superior and inferior concha portions which receives the concha ridge. The ear piece also has an intermediate portion 22 between the aforementioned upper and lower portions 12 and 18 which joins the upper and lower portions and which is grooved as at 24 to receive the inferior crus.

In use, the lower portion is inserted into the ear with the terminal portion 26 extending somewhat into the ear canal. A hole 28, as is conventional, is provided in this terminal portion too allow sound vibrations to enter the ear canal. It is seen that the nose portion 16 which fits in the internal helix in the helix root together with the groove which embraces and engages the inferior crus, co-acts with the ear structure to maintain and hold the device in position with the upper portion overlaying the triangular fossa and the lower portion overlaying the superior and inferior concha and concha ridge, thus providing a holding means for maintaining the ear piece within the ear cavity. The surfaces of the ear piece 10 are curved as illustrated to snugly fit within the ear cavity and to generally conform to the surfaces in the ear cavity. The ear piece may be of an suitable material; however, it is preferred that it is of rubbery material so as to be comfortable in use during an extended period of time.

In the embodiment shown in FIG. 3A–3D, it is seen that on the ear piece 10′ there is a pattern of bumps, such as 30, on the upper and lower portions and if desired on the intermediate portion 22. These bumps are arranged in a pattern and located to correspond to the previously identified acupuncture points known in the field.

Figure 4:
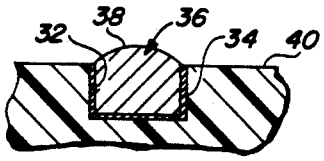
FIG. 4 is a view in cross-section through one of the bumps shown in the embodiment of FIGS. 3A, 3B, 3C and 3D and in lieu of a bump, there is provided a recess in which there is a magnet with a portion extending from the surface.

As seen in FIG. 4, the upper and lower portions may be provided, instead of bumps, with recesses 32. In each of the recesses, a magnet 36 is captivated by an adhesive means such as that indicated by the numeral 34. In this embodiment, a portion of the magnet extends out of the ear piece surface 40 and forms a magnetic bump 38.

Figure 5:
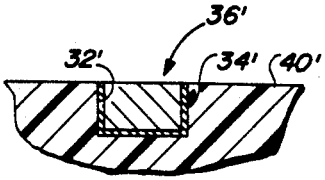
FIG. 5 is a view similar to FIG. 4 in cross-section and illustrating a magnet which has an exterior surface which is flush with the surface of the ear piece at an acupuncture site.

In the embodiment shown in FIG. 5, the magnet 36′ has an outermost surface which is flush with the surface 40′ of the ear piece and is held in the recess 32′ by the adhesive coating 34′.

It has been found that magnets such as ceramic magnets of 300-500 gauss strength are effective in this type of therapy, since the negative pole in contact with the ear surfaces tends to sedate a patient while the positive end seems to effect the energy activity at the location. A suitable material for the ear piece is a rubbery silicon material or, alternatively, a hard plastic acrylic. The construction provided in the various embodiments includes a holding means on an ear piece which also includes an upper portion which can have a pattern in relief to treat the triangular fossa acupuncture points as well as the acupuncture points of the superior and inferior concha and concha ridge. The embodiment shown, whether with or without bumps, magnetic or otherwise, provides an improved ear piece to be carried by a person in their ear cavity. In the case of the magnetic embodiment, a supply of the ear pieces with recesses may be supplied to a health provider who, in use, selects which recess or recesses will be provided with magnet means.

While this invention has been shown and described in several embodiments, it is recognized that departures may be made within the spirit and scope of the inventions which should therefore not be limited except as set forth in the claims herein and in accordance with the doctrine of equivalents.

What is claimed is:

1. An ear piece to be inserted and dwell in a human ear, said ear piece having an outside surface and an inside surface, said inside surface being sized and configured to confront the outside surface in a human ear cavity with a) an upper portion overlaying the triangular fossa, b) with a lower portion overlaying the inferior and superior concha and concha ridge areas, and c) a grooved bridge portion interconnecting the upper and lower portions and defining a first groove portion to receive and embrace the inferior crus, and a second grooved portion to embrace the conch ridge;

said lower portion including a terminal end with a through hole sized and configured to extend into the ear canal, said hole permitting sound vibrations to enter into the ear canal, and said upper portion having a nose portion sized and configured to nest in the internal helix above the inferior crus of a human ear.

2. An ear piece as set forth in claim 1 wherein the ear piece is of rigid, plastic material.

3. An ear piece as set forth in claim 1 wherein said ear piece is of rubbery material.

4. An ear piece as set forth in claim 1 wherein said outside surface of said ear piece includes a plurality of bumps arranged in a pre-selected pattern selected to correspond to acupuncture points.

5. An ear piece as set forth in claim 4 wherein said ear piece is of a rubbery material.

6. An ear piece as set forth in claim 4 wherein said ear piece is of rigid material.

7. An ear piece as set forth in claim 4 wherein a plurality of recesses in a pre-selected pattern is provided on said upper and lower portions and a magnet means is secured in each of said recesses.

8. An ear piece as set forth in claim 7 wherein a magnet protrudes from each recess defining a pattern in relief to confront the surface of the ear.

9. An ear piece as set forth in claim 8 wherein said ear piece is of rubbery material.

10. An ear piece as set forth in claim 8 wherein said ear piece is of rigid material.

* * * * *